US010224159B2

(12) United States Patent
Shen

(10) Patent No.: US 10,224,159 B2
(45) Date of Patent: Mar. 5, 2019

(54) KEY STABILIZER

(71) Applicants: LITE-ON ELECTRONICS (GUANGZHOU) LIMITED, Guangzhou (CN); LITE-ON TECHNOLOGY CORPORATION, Taipei (TW)

(72) Inventor: Hai-Nan Shen, Dong Guan (CN)

(73) Assignees: LITE-ON ELECTRONICS (GUANGZHOU) LIMITED, Guangzhou (CN); LITE-ON TECHNOLOGY CORPORATION, Taipei (TW)

( * ) Notice: Subject to any disclaimer, the term of this patent is extended or adjusted under 35 U.S.C. 154(b) by 0 days.

(21) Appl. No.: 15/653,199

(22) Filed: Jul. 18, 2017

(65) Prior Publication Data

US 2018/0197699 A1 Jul. 12, 2018

(30) Foreign Application Priority Data

Jan. 9, 2017 (CN) ..... 2017 1 0014511

(51) Int. Cl.

| | |
|---|---|
| ***H01H 13/7057*** | (2006.01) |
| ***H01H 13/7065*** | (2006.01) |
| ***H01H 13/70*** | (2006.01) |
| *H01H 13/18* | (2006.01) |
| *H01H 13/58* | (2006.01) |

(52) U.S. Cl.

CPC .... *H01H 13/7057* (2013.01); *H01H 13/7013* (2013.01); *H01H 13/7065* (2013.01); *H01H 13/186* (2013.01); *H01H 13/58* (2013.01); *H01H 2205/014* (2013.01); *H01H 2205/03* (2013.01)

(58) Field of Classification Search

CPC ..... H01H 3/122; H01H 13/705; H01H 13/14; H01H 2233/056; H01H 2221/024; H01H 2221/058; H01H 2233/036; H01H 3/125; H01H 13/04; H01H 13/20

USPC ..... 200/5 A, 314, 341–345, 293–296

See application file for complete search history.

(56) References Cited

U.S. PATENT DOCUMENTS 6,495,782 B1 * 12/2002 Huang ..... H01H 3/122 200/341

2012/0061220 A1 * 3/2012 Dai ..... H05K 5/0017 200/341

* cited by examiner

*Primary Examiner* — Ahmed M Saeed

(74) *Attorney, Agent, or Firm* — Li & Cai Intellectual Property (USA) Office

(57) ABSTRACT

A key stabilizer is provided, in which the key stabilizer includes a keycap and a balance bar. The keycap has a bottom surface and two protruding portions disposed thereon. The keycap moves back and forth along a vertical direction between a top position and a bottom position. Each of the two protruding portions has an engaging portion at the end thereof. The bottom surface faces the bottom position, and the two protruding portions are arranged along a horizontal direction that is perpendicular to the vertical direction. The balance bar has a hinge portion and two side portions respectively connected to both ends of the hinge portion. The hinge portion is positioned on a rotation axis parallel to the horizontal direction. The end of each of the two side portions that is away from the hinge portion is inserted into the engaging portion.

14 Claims, 14 Drawing Sheets

KEY STABILIZER

BACKGROUND OF THE INVENTION

1. Field of the Invention

The present disclosure relates to a key stabilizer; more particularly, to a key stabilizer for mechanical keyboards.

2. Description of Related Art

The main components of a conventional mechanical key structure include a keycap, a base plate, and a key shaft assembly connected therebetween. When the keycap of a key is being pressed, whether the keycap can move smoothly towards the base plate depends on the stability of the actuation mechanism within the key shaft assembly. That is to say, if the actuation mechanism within the key shaft assembly is unstable, the keycap may tilt or quiver on the way to the base plate, which may cause not only typing errors but also unenjoyable user experience. Furthermore, some keyboard keys that have longer lengths, such as the space bar, tilt more easily than those with smaller aspect ratios as the key shaft assemblies of such keyboard keys support only the central part of the keycap. Therefore, disposing a balance mechanism between the keycap and the base plate of a mechanical keyboard is a common solution in the art, by which both ends of such long keyboard keys can move down together even when only one end is pressed.

A conventional mechanical key with the above-mentioned balance mechanism includes two auxiliary shafts disposed at both sides of the key shaft assembly and a balance lever connecting the two auxiliary shafts with one another. Each of the auxiliary shafts includes a case and a guiding shaft. The bottom end of the guiding shaft is inserted into the case and the upper portion of the guiding shaft protrudes from the case. Furthermore, an insertion portion is disposed on the upper portion of the guiding shaft. The bottom surface of the keycap includes an insertion hole at both ends thereof. The insertion holes correspond to the insertion portions so that the upper portion of the guiding shaft can be inserted into the bottom surface of the keycap. The balance lever is connected between the bottom ends of the two guiding shafts so that the two guiding shafts can be actuated by each other through the balance lever and the keycap can move vertically as a whole without either side of the keycap moving faster than the other.

However, a conventional mechanical keyboard is expensive since the structure of the auxiliary shafts is complicated. Furthermore, when installing the balance mechanism in a conventional mechanical key, a specially made jig is required to help fix the auxiliary shafts at a same height so that the balance lever can be inserted into the case of the auxiliary shaft from the bottom thereof and then into the balance-lever insertion holes at the bottom ends of the auxiliary shafts. The auxiliary shafts and the balance lever that are assembled together are afterwards installed on the base plate. The need for a specially made jig renders the assembly process complicated and thus increases the assembly costs.

Based on the above reasons, the high cost and complicated assembly process associated with the balance mechanism of the conventional mechanical keyboard leave room for improvement in the art. Therefore, to provide a structural solution in order to improve the balance mechanism of a prior art mechanical key has become an important issue in the art.

SUMMARY OF THE INVENTION

Accordingly, the object of the present disclosure is to provide a key stabilizer with simplified structure that is easy to be assembled.

In order to achieve the aforementioned objects, the present disclosure provides a key stabilizer including a keycap and a balance bar. The keycap has a bottom surface and two protruding portions disposed thereon. The keycap moves back and forth along a vertical direction between a top position and a bottom position. Each of the two protruding portions has an engaging portion at the end thereof. The bottom surface faces the bottom position, and the two protruding portions are arranged along a horizontal direction that is perpendicular to the vertical direction. A balance bar has a hinge portion and two side portions respectively connected to both ends of the hinge portion, in which the hinge portion is positioned on a rotation axis that is parallel to the horizontal direction, and the end of each of the two side portions away from the hinge portion is inserted into the engaging portion so that when the keycap moves back and forth along the vertical direction, the two protruding portions are actuated by each other through the balance bar, and the two bar portions are actuated by the two protruding portions to swing between an uppermost swing position and a lowermost swing position.

In one embodiment of the present disclosure, the key stabilizer further includes a base plate and two case bodies disposed thereon. Each of the case bodies includes an accommodating concavity into which a bottom end of each of the two protruding portions is inserted. The two case bodies respectively correspond to the two protruding portions. The hinge portion of the balance bar is pivotally connected to one side of each of the two case bodies. The two side portions of the balance bar are respectively accommodated in the two accommodating concavities and connected to the bottom ends of the two protruding portions.

In one embodiment of the present disclosure, each of the engaging portions includes an opening portion at one end thereof, in which each of the opening portions has a constraining portion constraining the motion of the side portion inserted into the engaging portion so that the side portion that has been inserted into the engaging portion cannot exit therefrom.

In one embodiment of the present disclosure, each of the case bodies includes a constraining member disposed on the bottom surface of the accommodating concavity, in which a guiding recess is disposed on each of the constraining members at one side thereof facing the keycap, and each guiding recess corresponds to each of the side portions respectively such that when the two side portions are pushed by the bottom ends of the two protruding portions to the lowermost swing position, the guiding recesses fix the side portions at the lowermost swing position in a manner such that the two side portions correspond to the opening portions of the two engaging portions so that when the two protruding portions move to the bottom position along with the keycap, the side portions are fitted into the engaging portions via the opening portions with the guidance of the guiding recesses.

The present disclosure provides a key stabilizer having a simplified structure compared to that of a conventional key stabilizer structure, and obviates the need for a specially made jig when assembling the key stabilizer, facilitating the assembly process thereof.

In order to further the understanding of the present disclosure, the following embodiments are provided along with illustrations to facilitate the disclosure of the present disclosure.

DETAILED DESCRIPTION OF THE PREFERRED EMBODIMENTS

The aforementioned illustrations and following detailed description are exemplary for the purpose of further explaining the scope of the present disclosure. Other objectives and advantages related to the present disclosure will be illustrated in the following description and appended drawings.

Figure 1:
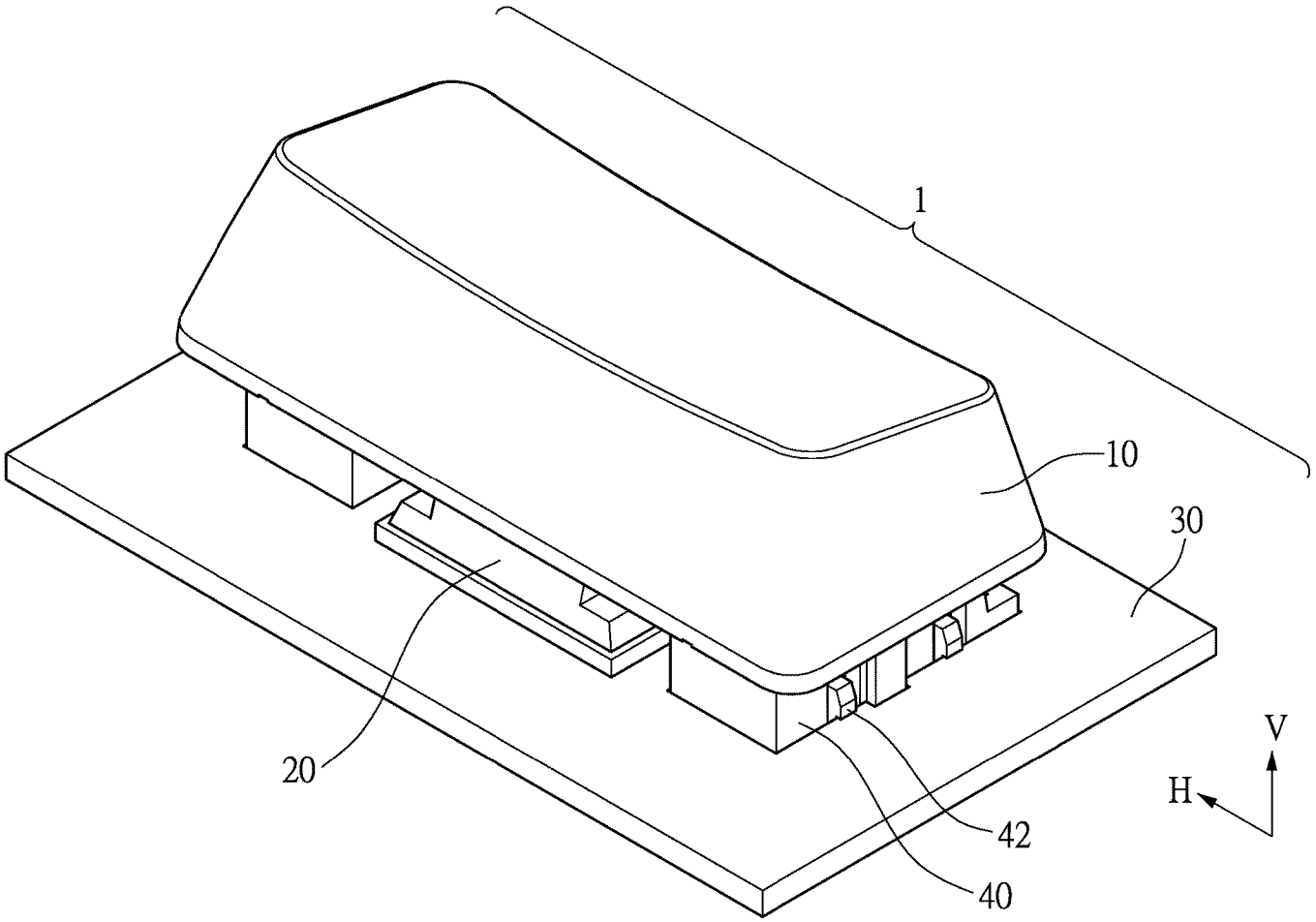
FIG. 1 is a perspective view illustrating the key stabilizer of the present disclosure.
Figure 2:
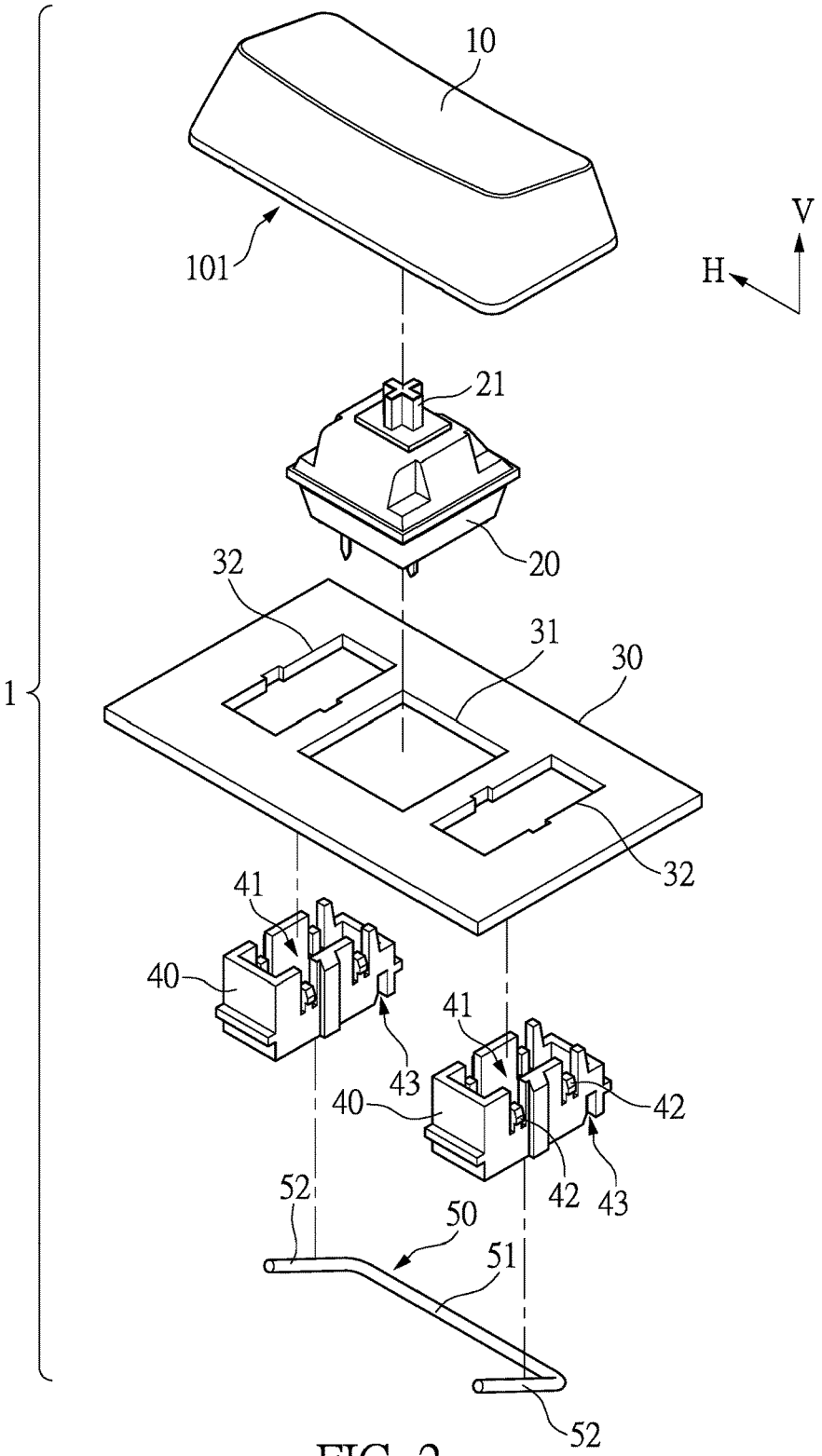
FIG. 2 is a perspective exploded diagram illustrating the key stabilizer of the present disclosure.

With reference to FIGS. 1 and 2, a key stabilizer 1 according to one embodiment of the present disclosure includes a keycap 10, a key shaft 20, a base plate 30, two case bodies 40, and a balance bar 50.

Figure 3:
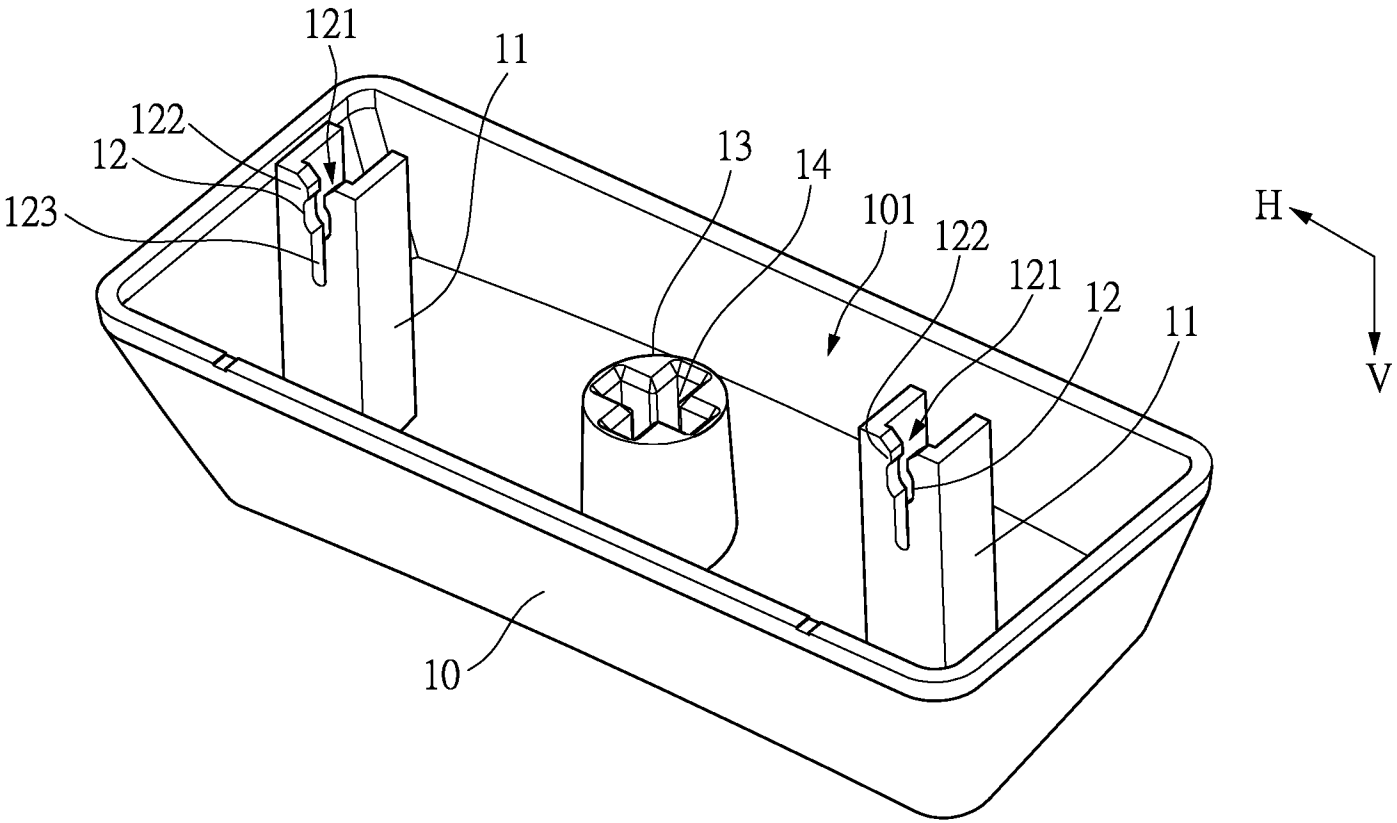
FIG. 3 is a perspective view illustrating a keycap of a key stabilizer according to the present disclosure as seen from below.
Figure 5:
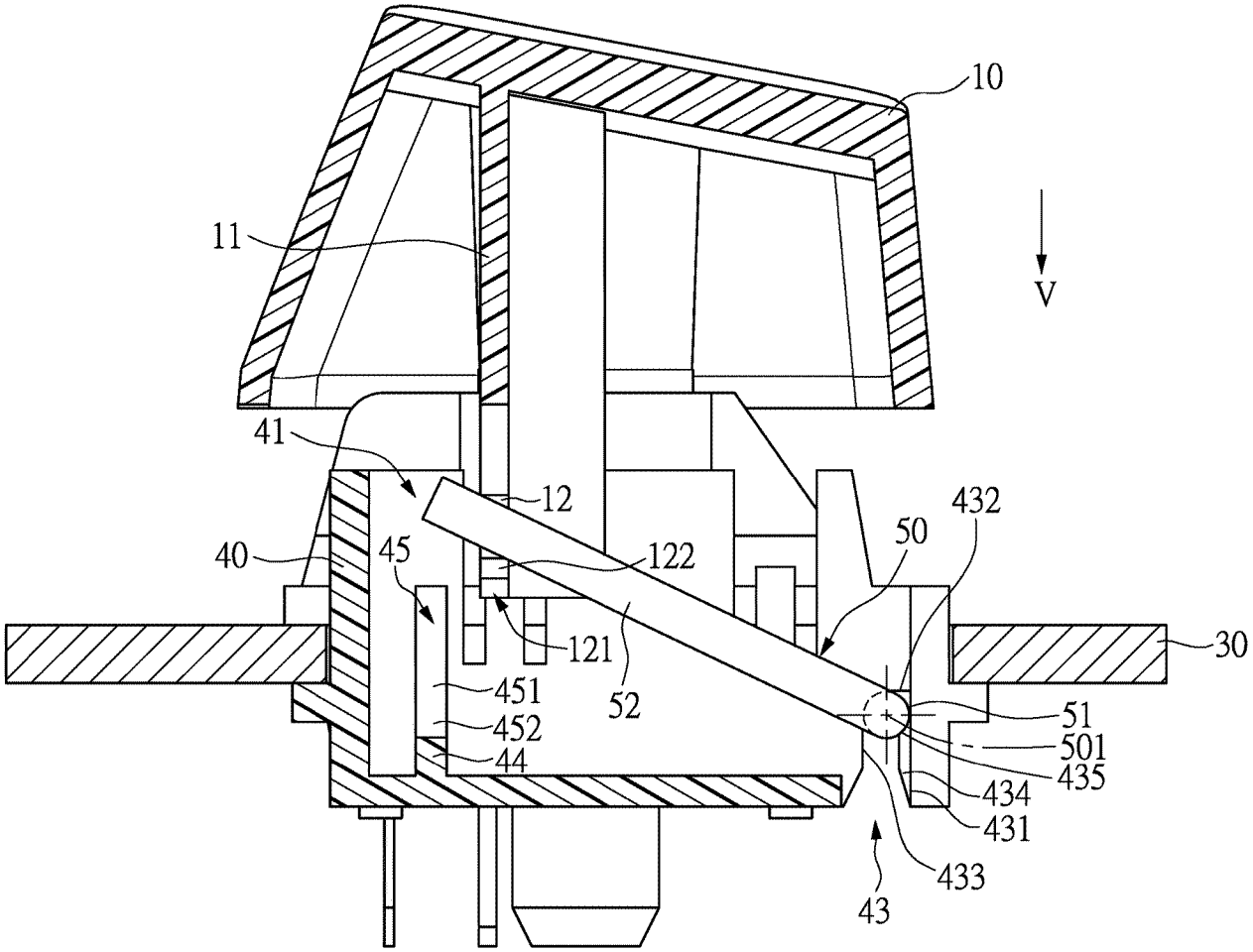
FIG. 5 is a sectional view illustrating the key stabilizer of the present disclosure with the keycap at a top position and a balance bar at an uppermost swing position.
Figure 6:
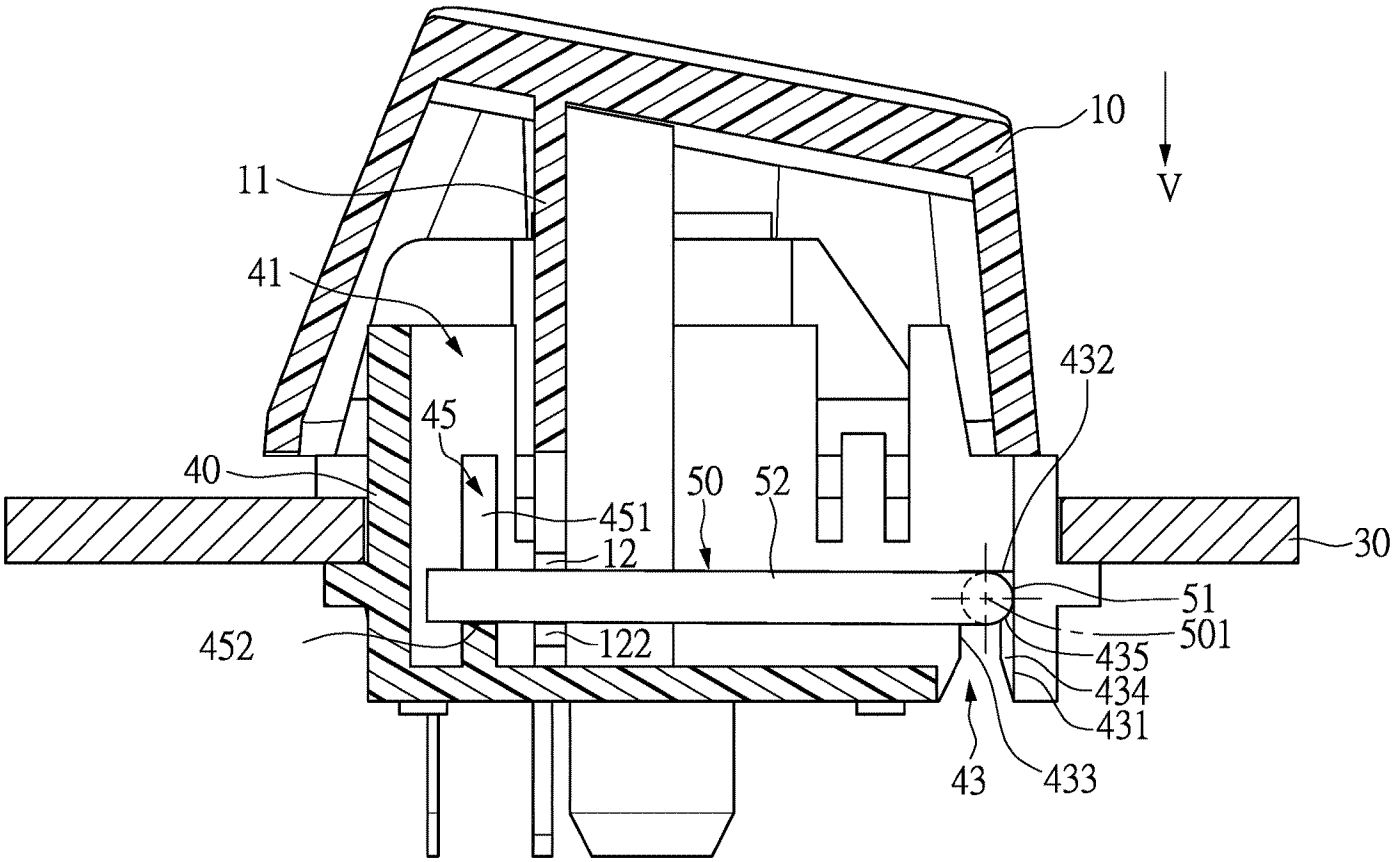
FIG. 6 is a sectional view illustrating the key stabilizer of the present disclosure with the keycap at a bottom position and the balance bar at a lowermost swing position.

Referring to FIGS. 1, 2, and 3, in this embodiment, the keycap 10 can be installed on the base plate 30 through the key shaft 20 in a manner such that the keycap 10 can move vertically relative to the base plate 30. The keycap 10 is an elongated key, e.g. a space bar. As illustrated in FIGS. 5 and 6, the keycap 10 can move back and forth along a vertical direction between a top position and a bottom position. When pressed, the keycap 10 moves from the top position to the bottom position, through which the key shaft 20 is triggered to send out a signal.

The direction parallel to the vertical direction is labeled V in FIG. 3. The direction parallel to the longitudinal side of the keycap 10 is defined as a horizontal direction and labeled H in FIG. 3. The vertical direction is perpendicular to the horizontal direction.

The upper side of the keycap 10 is where a keyboard user presses the key stabilizer 1. The bottom side of the keycap 10 includes a bottom surface 101. With reference to FIG. 3, a protruding pole 13 is disposed at the middle portion of the bottom surface 101, and an insertion socket 14 is disposed at the center of the protruding pole 13. In the present embodiment, the insertion socket 14 is cross-shaped. The keycap 10 has two protruding portions 11 disposed on the bottom surface 101 and arranged along the horizontal direction. Each of the protruding portions 11 has an engaging portion 12 at a bottom end thereof. The two protruding portions 11 extend downwardly from the bottom surface 101.

With reference to FIGS. 1 and 2, the base plate 30 includes a first accommodating hole 31 disposed at the middle position thereof. The key shaft 20 can be installed on the base plate 30 via the first accommodating hole 31. The base plate 30 includes two second accommodating holes 32 respectively corresponding to the two case bodies 40 so that the two case bodies 40 can be installed on the base plate 30. An insertion member 21 is disposed on top of the key shaft 20. In the present embodiment, the insertion member 21 has a cross section of the same shape as that of the insertion socket 14 such that the insertion member 21 can be fitted into the insertion socket 14 and the key shaft 20 can be connected with the keycap 10.

With the key shaft 20, the keycap 10 can move vertically along the vertical direction between the top position and the bottom position, in which the key shaft 20 exerts a force on the keycap 10 such that the keycap 10 is pushed back to the top position from the bottom position.

Figure 4:
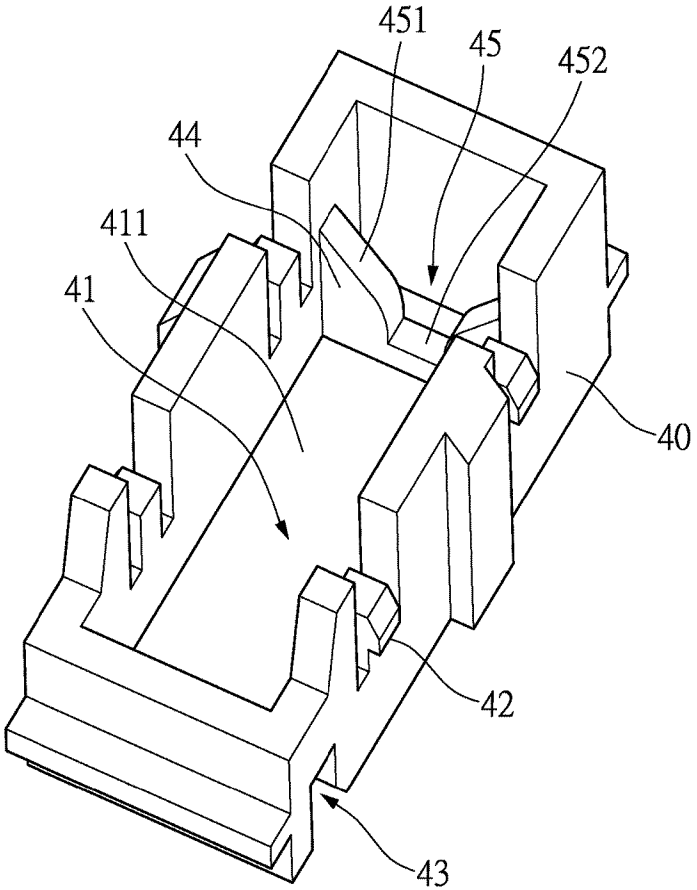
FIG. 4 is a perspective view illustrating one of the case bodies of the key stabilizer according to the present disclosure.

Referring to FIGS. 2 and 4, the two case bodies 40 are disposed in the two second accommodating holes 32 of the base plate 30 respectively. In the present embodiment, the two case bodies 40 are rectangular. The outer shape of the two case bodies 40 correspond to the outline of the two second accommodating hole 32 so that the two case bodies 40 can be inserted into the two second accommodating holes 32. The inner side of each of the case bodies 40 includes an accommodating concavity 41. The accommodating concavity 41 has an opening at the top thereof and a bottom portion 411 at the bottom thereof. A plurality of hook members 42 are disposed on the lateral side of each of the two case bodies 40. When the two case bodies 40 are inserted into the two second accommodating holes 32 of the base plate 30, the plurality of hook members 42 are engaged with the edge of the second accommodating holes 32 such that the case bodies 40 are positioned in the two second accommodating holes 32 respectively.

Figure 7:
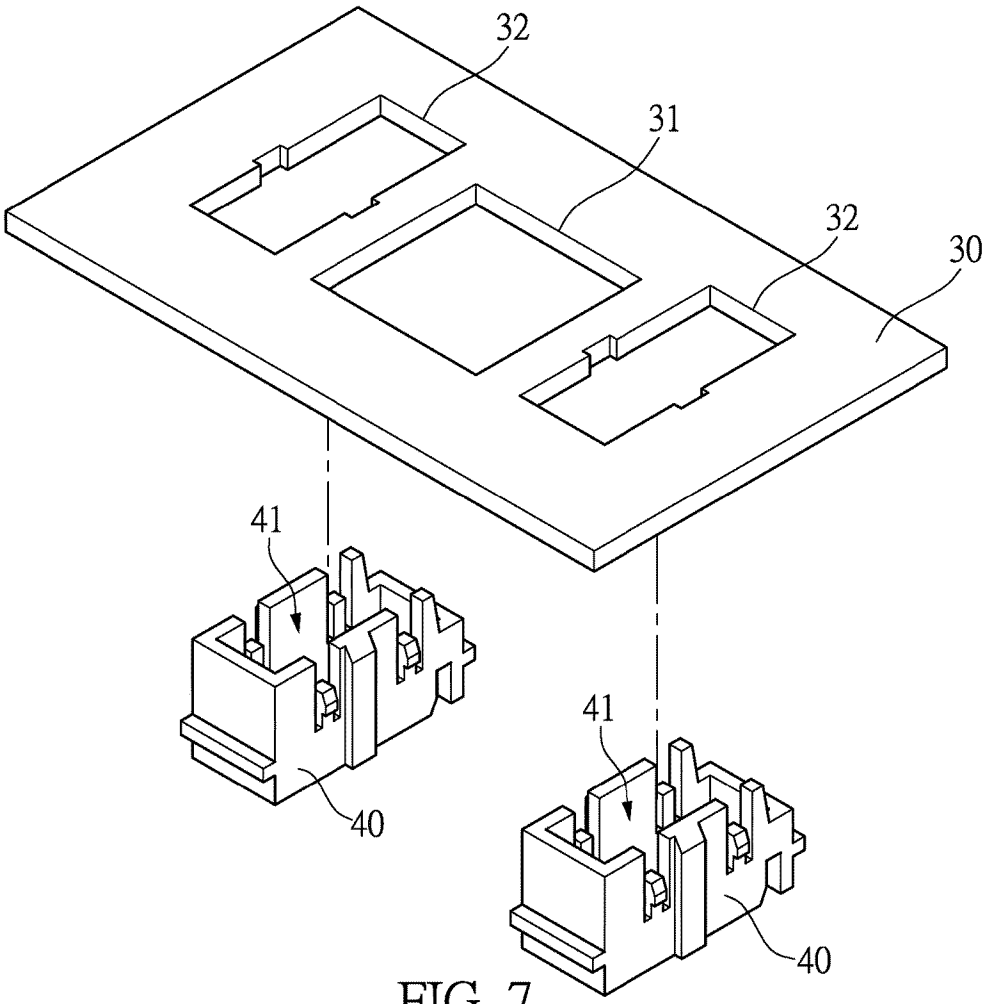
FIGS. 7 to 11 illustrate the assembly process of the key stabilizer of the present disclosure with perspective diagrams.

With reference to FIGS. 2 and 7, the two case bodies 40 are positioned in the two second accommodating hole 32 in a manner that the two case bodies 40 are arranged respectively on two sides of the key shaft 20 along the horizontal direction, and the opening of the accommodating concavity 41 of each of the case bodies 40 faces the two protruding portions 11 and correspond thereto such that the bottom ends of the two protruding portion 11 can be inserted into the two accommodating concavities 41 respectively.

Referring to FIGS. 4 and 6, each of the case bodies 40 includes an indented portion 43 at a lateral side thereof. The two indented portions 43 are arranged along the horizontal direction so that the balance bar 50 can be inserted into the case bodies 40 through the two indented portions 43. With reference to FIG. 2, the balance bar 50 is a U-shaped rail including a straight hinge portion 51 and two side portions 52 connected to both ends of the hinge portion 51.

Figure 9:
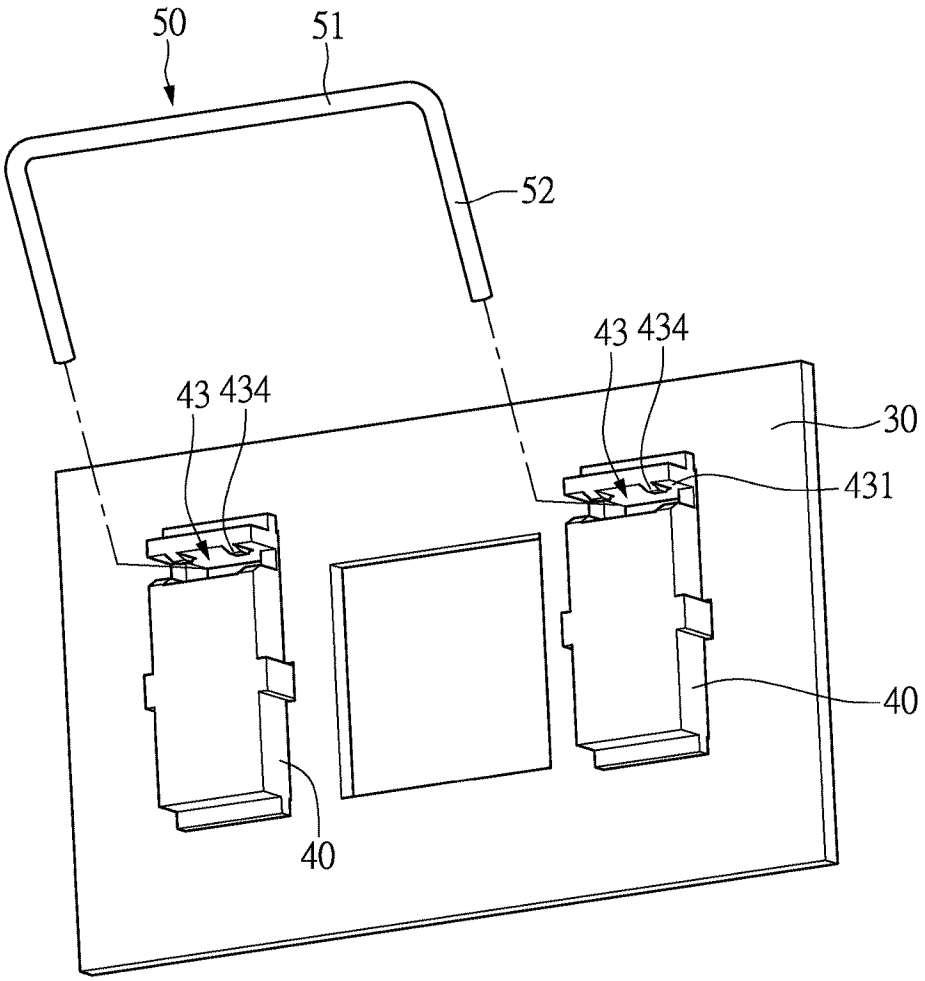

With reference to FIGS. 6 and 9, the two indented portions 43 are respectively disposed on one lateral side of each of the case bodies 40 along the horizontal direction. Referring to FIG. 6, a width of the indented portion 43 is greater than the diameter of the balance bar 50 so that the ends of the two side portions 52 can be inserted into the two accommodating concavities 41 of the two case bodies 40 through the two indented portions 43 and the hinge portion 51 of the balance bar 50 can then be fixed in the two indented portions 43. In this way, the balance bar 50 can be pivotally connected to the two case bodies 40 at one side thereof in a manner that the balance bar 50 is parallel to the horizontal direction.

With reference to FIG. 6, the indented portion 43 is a notched recess extending upwards from the bottom surface of the case bodies 40 along the vertical direction. Each indented portion has two side walls 431, 433 and one top wall 432 between the upper ends of the two side walls 431, 433. The distance between the two side walls 431, 433 is greater than or equal to the diameter of the hinge portion 51, such that the hinge portion 51 can be accommodated between the two side walls 431, 433 of the indented portion 43. One of the two side walls 431 includes a plurality of fixing protrusions 434 protruding from the side wall 431. The upper side of each of the fixing protrusions 434 has a contact surface 435 corresponding to the bottom side of the hinge portion 51 of the balance bar 50. When the hinge portion 51 of the balance bar 50 is positioned at the innermost part of the indented portion 43, the upper side of the hinge portion 51 contacts the top wall 432 of the indented portion 43, the lateral sides of the hinge portion 51 contact the two side walls 431, 433 of the indented portion 43, and the bottom side of the indented portion 43 contacts the contact surface 435 of the fixing protrusions 434, such that the hinge portion 51 is restrained from moving by the top wall 432, the two side walls 431, 433, and the contact surface 435 and thus positioned on a rotation axis 501 that is parallel to the horizontal direction.

In this way, the hinge portion 51 of the balance bar 50 can be pivotally positioned on the rotation axis 501 at one side of the two case bodies 40 through the indented portions 43 and the plurality of fixing protrusions 434, by which the two side portions 52 can swing about the rotation axis 501. More specifically, since the ends of the two side portions 52 away from the hinge portion 51 are connected to the engaging portions 12 at the bottom of the two protruding portions 11, the two side portions 52 can be actuated by the two protruding portions 11 to swing about the rotation axis 501 when the two protruding portions 11 move vertically along with the keycap 10.

With reference to FIGS. 5 and 6, when the keycap 10 moves to the top position, the two side portions 52 are actuated by the two protruding portion 11 and swing to the uppermost swing position, and when the keycap 10 moves to the bottom position, the two side portions 52 are actuated by the two protruding portions 11 and swing to the lowermost swing position. Since the balance bar 50 is a rigid rail body in which the two side portions 52 are parallel to each other, the two side portions 52 can remain parallel to each other during the actuation of the balance bar 50 by the two protruding portions 11 of the keycap 10. That is to say, when the keycap 10 is moving back and forth between the top position and the bottom position, the two protruding portions 11, which is connected to the two side portions 52 and actuated thereby, can remain at the same height as one another through the connection with the two side portions 52 so that the keycap 10 will not tilt.

The assembly method and the connecting manner of the structure between the two protruding portions 11 of the keycap 10 and the engaging portions 12 will be described below.

Referring to FIG. 3, an engaging portion 12 is disposed at the bottom end of each of the protruding portions 11 of the keycap 10. The engaging portion 12 is an oval-shaped hole, the longitudinal axis of which is approximately parallel to the horizontal direction. Each of the engaging portions 12 includes an opening portion 121 at one end thereof, which faces the accommodating concavity 41 of each of the case bodies 40 after the keycap 10 and the key shaft 20 are assembled together. The opening portion 121 includes two stopper portions 122 respectively disposed on the two side walls thereof and extending towards the center of the opening portion 121.

A width of the engaging portion 12 is greater than or equal to the diameter of the side portion 52 of the balance bar 50 so that the side portions 52 can be accommodated in the engaging portion 12. Furthermore, the distance between the two stopper portions 122 is smaller than the diameter of the side portions 52 so that after the two side portions 52 are inserted into the two engaging portion 12, the two stopper portions 122 of each of the two engaging portions 12 constrain the two side portions 52 within the two engaging portions 12 such that the two side portions 52 cannot exit therefrom.

With reference to FIGS. 3 and 12 to 14, a chamfer is disposed on both side walls of the opening portion 121 in a manner such that the two side portions 52 can be inserted into the opening portion 121 smoothly. Moreover, another end of each of the engaging portions 12 is connected to a trough 123, in which the trough 123, the engaging portion 12, and the opening portion 121 are arranged along the vertical direction at the bottom of each of the protruding portions 11 so that the bottom portion of each of the protruding portions 11 is divided into two parts and is allowed to dilate outwards elastically. Therefore, when the two side portions 52 are being inserted into the engaging portion 12 through the opening portion 121, the stopper portion 122 of the opening portion 121 are pushed by the side portions 52 and dilate outwards so that the side portions 52 can enter in the engaging portion 12.

Figure 12:
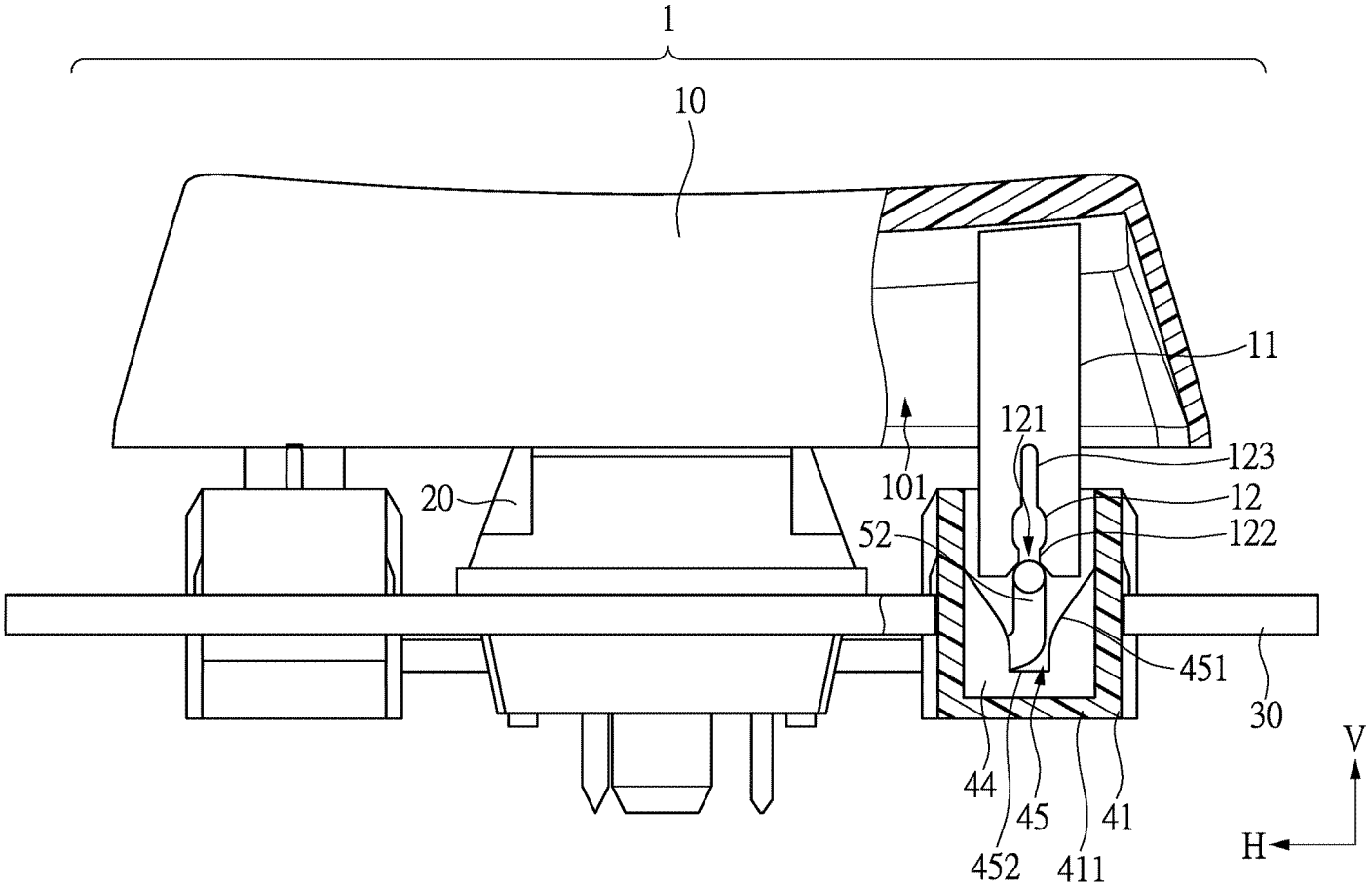
FIGS. 12 to 14 show a process in which two protruding portions of the keycap and two side portions of the balance bar are assembled together with sectional diagrams.
Figure 13:
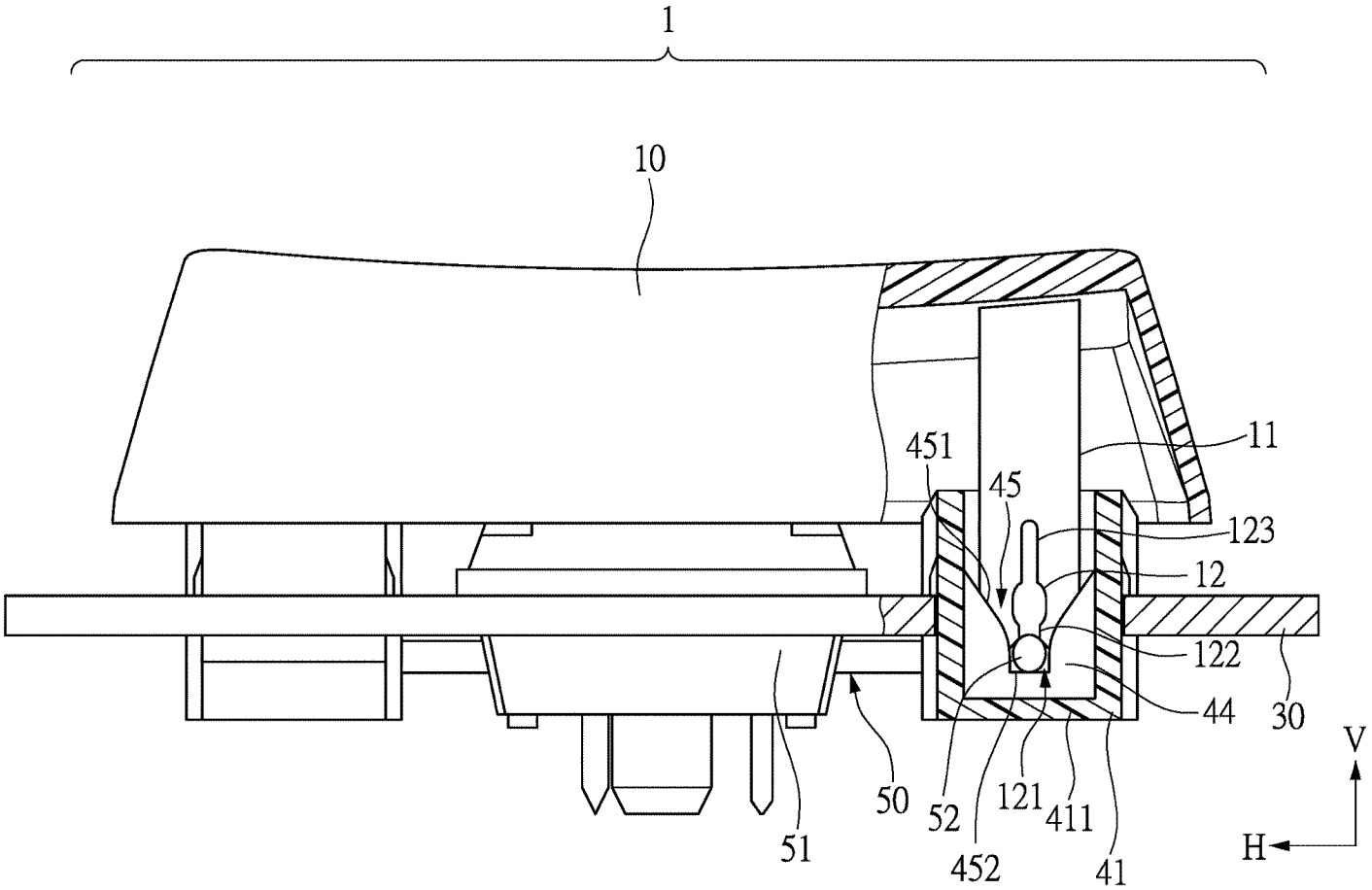
Figure 14:
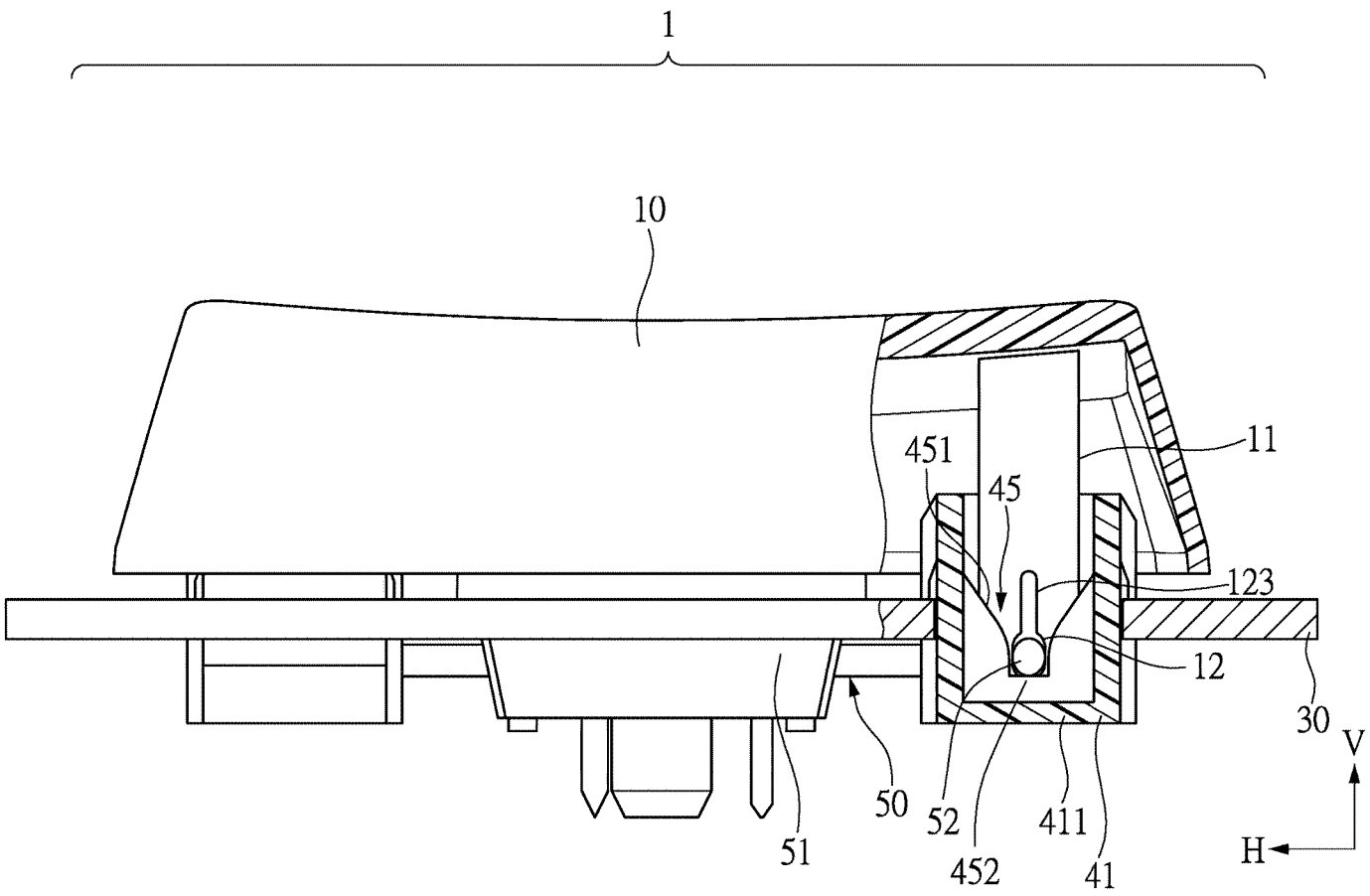

Referring to FIGS. 4 and 12 to 14, the accommodating concavity 41 of each of the case bodies 40 includes a constraining member 44 disposed on the bottom surface of the accommodating concavity 41, and a guiding recess 45 is disposed on each of the constraining members 44 at one side thereof facing the keycap 10. In the present embodiment, the two guiding recesses 45 each includes two inclined shoulder portions 451 and one central portion 452 disposed therebetween. The two shoulder portions 451 are slopes formed on the top surface of the constraining member 44 and lean towards the center of the accommodating concavity 41 and the bottom surface of the accommodating concavity 41. The central portion 452 is connected to the ends of the two should portions 451 and recessed downwards to form an indentation. With reference to FIGS. 12 to 14, the center of each guiding recess 45 is in alignment with the center of the engaging portion 12 and the opening portion 121 at the bottom end of each of the protruding portion 11 so that when the two side portions 52 of the balance bar 50 is fitted into the central portion 452 of the guiding recess 45, the two side portions 52 are also in alignment with the two engaging portions 12 and the two opening portions 121.

Referring to FIGS. 6 and 13, the central portion 452 of the guiding recess 45 has a height that corresponds to the bottom portion of each of the side portions 52 when the two side portions 52 swing to the lowermost swing position. Therefore, with reference to FIG. 6, when the two side portions 52 swing to the lowermost swing position, the bottom side of the two side portions 52 contact the bottom surface of the central portion 452 so that the two side portions 52 cannot swing further downwards.

With the constraint and guide of the guiding recess 45, when the two side portions 52 swing to the lowermost swing position, the side portions 52 can be fixed at the lowermost swing position where the side portions 52 is in alignment with the opening portion 121 of the engaging portion 12, by which when the keycap 10 is pressed, the two side portions 52 can enter the engaging portion 12 through the opening portion 121, and then the two side portions 52 and the engaging portion 12 can be assembled together.

Figure 8:
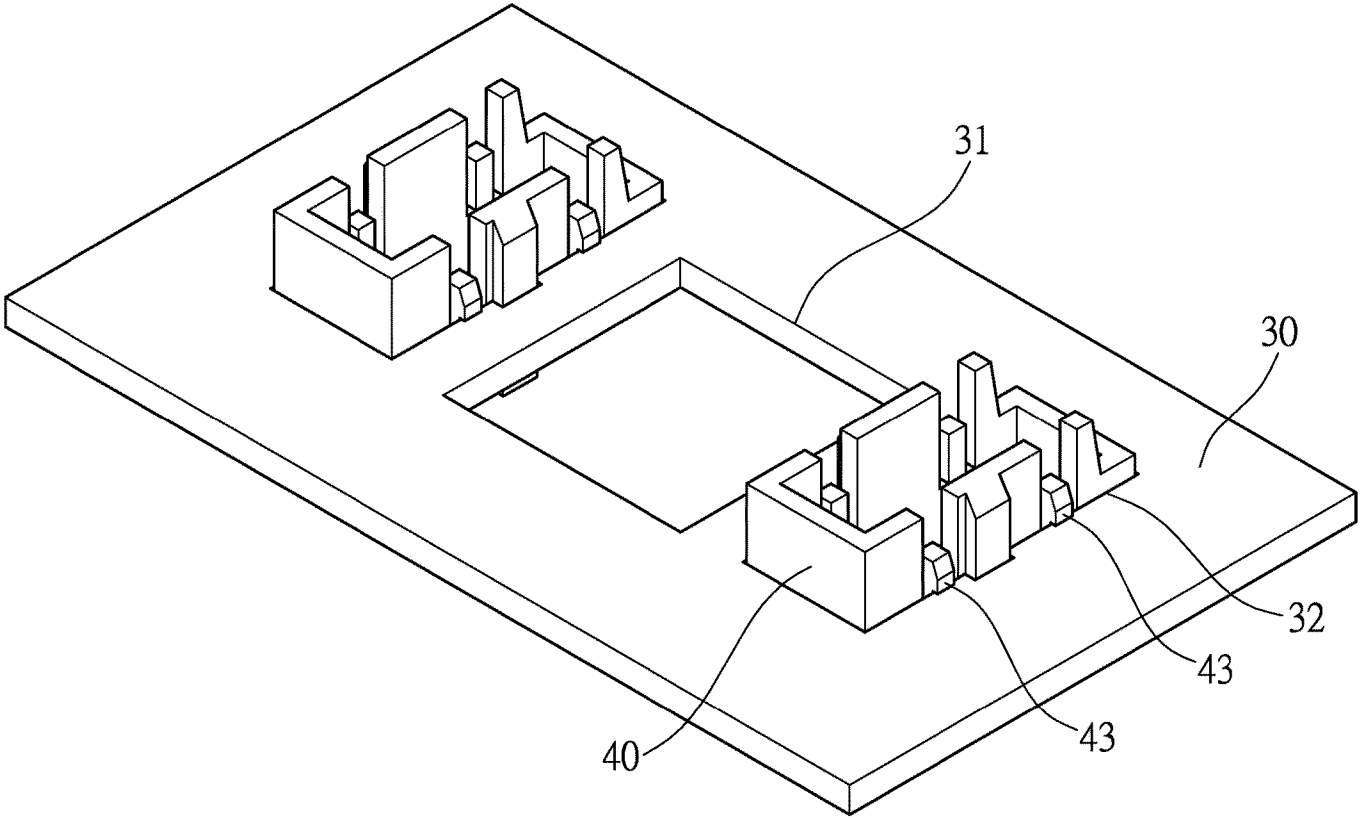

The assembly process of the key stabilizer of the present disclosure will be described below. With reference to FIG. 7, the first step of the assembly process is to insert the two case bodies 40 into the two second accommodating holes 32 of the base plate 30 with the openings of the two case bodies 40 facing up. FIG. 8 illustrates the two case bodies 40 and the base plate 30 in an assembled state, in which the hook member 42 at the lateral side of each of the two case bodies 40 engage with the edge of the second accommodating holes 32 of the base plate 30 so that the two case bodies 40 are fixedly positioned in the base plate 30 and the two accommodating concavity 41 are at the same height.

Referring to FIG. 9, when assembling the balance bar 50 with the two case bodies 40, the ends of the side portions 52 are inserted into the two case bodies 40 through the indented portions 43, and then the balance bar 50 is pushed upwards until both sides of the hinge portion 51 of the balance bar 50 are positioned in the indented portions 43. In the present embodiment, a plurality of fixing protrusions 434 are disposed on the side wall 431 of the indented portion 43. Therefore, with reference to FIGS. 5 and 6, when engaging the hinge portion 51 of the balance bar 50 in the indented portion 43, an extra force is needed to push the hinge portion 51 through the fixing protrusion 434 such that the hinge portion 51 can reach the uppermost position inside the indented portion 43 and be positioned on the rotation axis 501.

Figure 10:
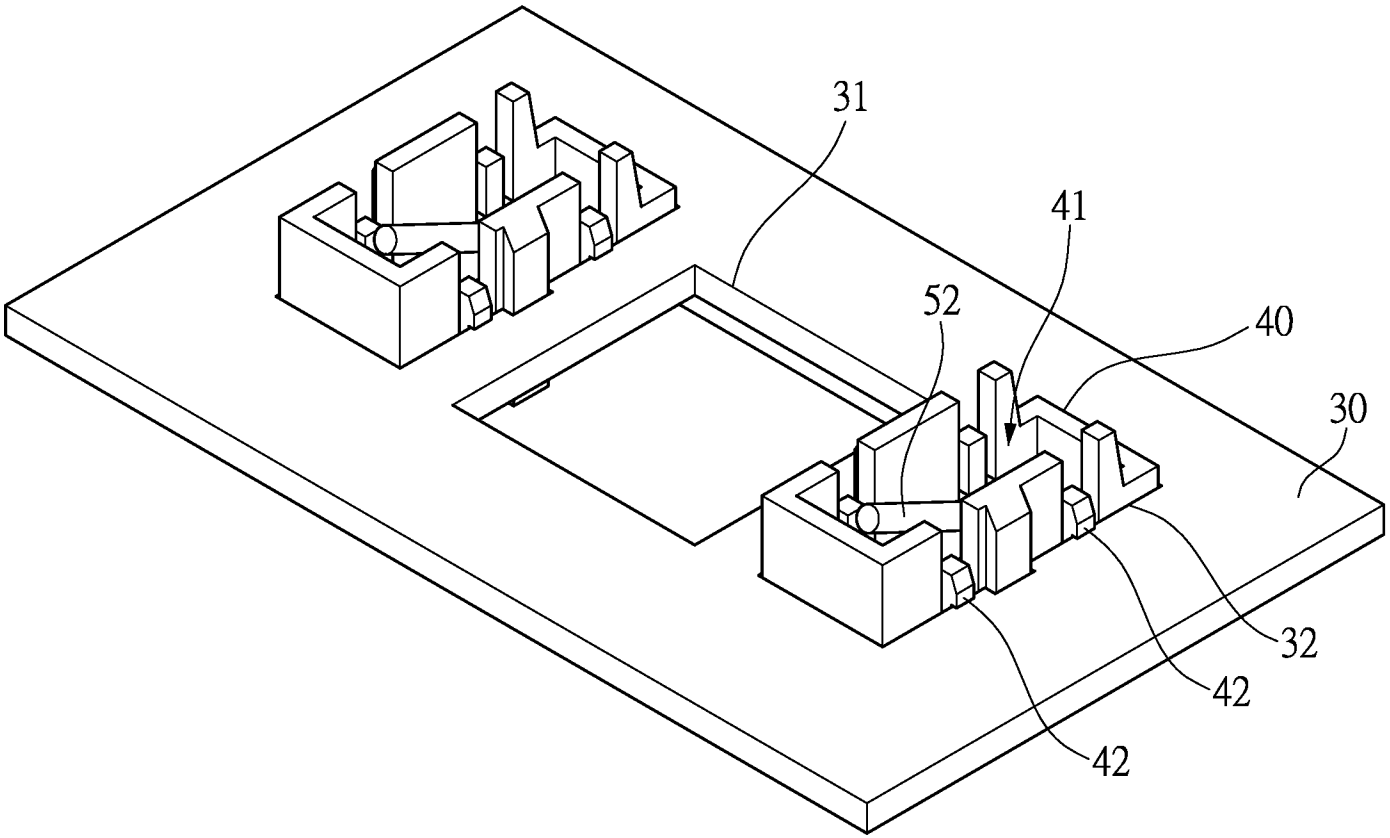

FIGS. 10 and 12 show the balance bar 50 having been inserted into the two case bodies 40. The two side portions 52 of the balance bar 50 are accommodated in the accommodating concavities 41, and the bottom ends of the two side portions 52 away from the hinge portion 51 are situated on top of the guiding recesses 45.

Figure 11:
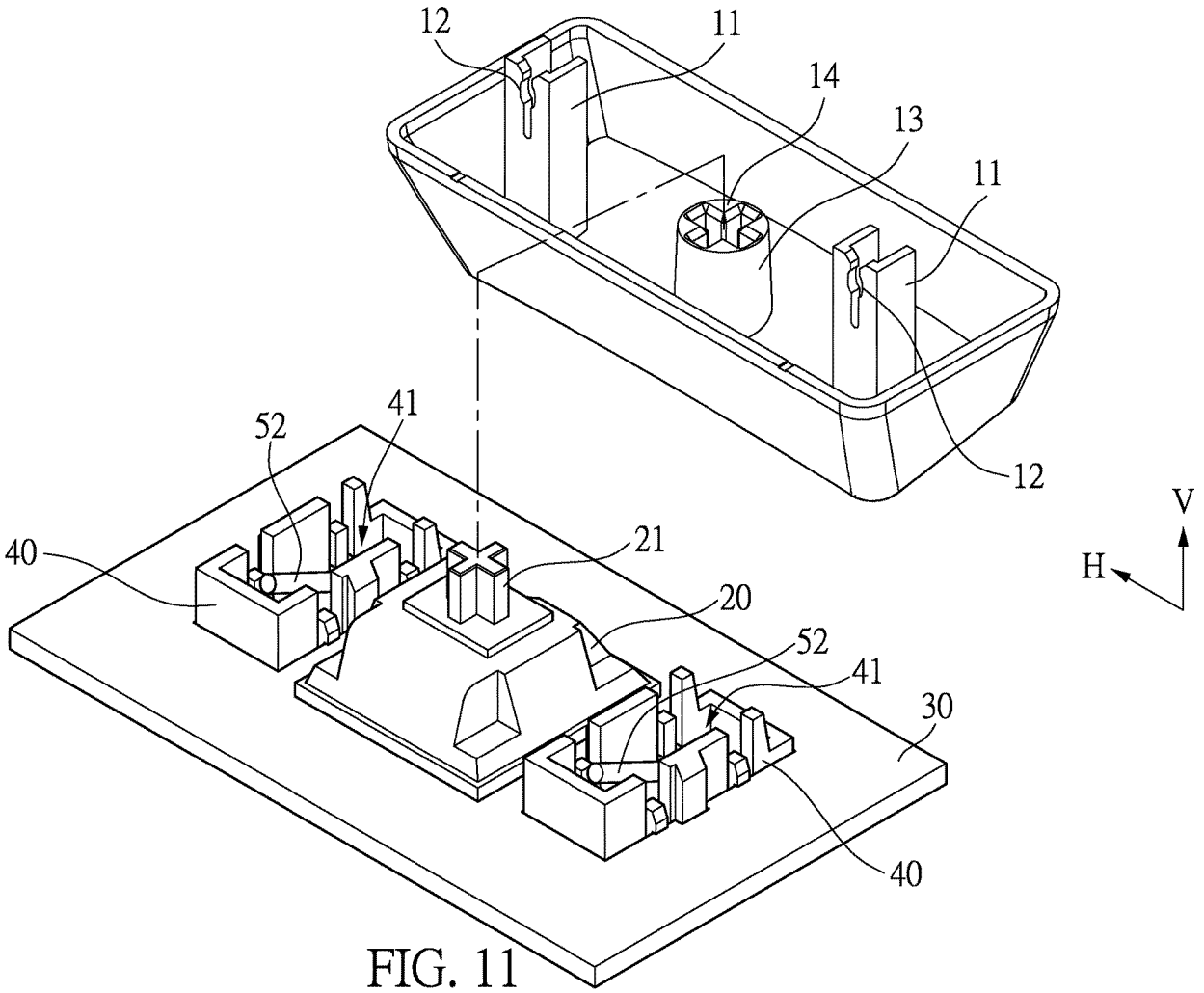

With reference to FIG. 11, the key shaft 20 is then disposed in the first accommodating hole 31 of the base plate 30. Afterwards, the insertion member 21 of the key shaft 20 is positioned to be in alignment with the protruding pole 13 on the bottom side of the keycap 10, and then the keycap 10 is pressed towards the bottom position, by which the insertion member 21 is inserted into the insertion socket 14, and the keycap 10 and the key shaft 20 are assembled together.

With reference to FIGS. 12 to 14, when the keycap 10 is pressed downwardly so that the keycap 10 and the key shaft 20 can be assembled together, the side portions 52 and the engaging portions 12 of the keycap 10 can be assembled together at the same time. FIG. 12 shows that the protruding portion 11 at the bottom side of the keycap 10 contacts the side portion 52, which is on top of the guiding recess 45 but not yet inserted into the engaging portion 12.

Referring to FIG. 13, the keycap 10 is afterwards pushed towards the bottom position, during which the two side portions 52 are pushed by the two protruding portions 11 and swing to the lowermost swing position, sliding along the two shoulder portions 451 of the guiding recess 45 to the central portion 452 of the guiding recess 45. After having reached the bottom surface of the central portion 452, the side portions 52 cannot swing further downward. Therefore, the side portions 52 remain at the lowermost swing position, and at the same time are in alignment with the opening portions 121 and the engaging portions 12 with the guide of the shoulder portions 451 of the guiding recess 45. When the two side portions 52 reach the bottom surface of the central portion 452 and stop swinging, the keycap 10 has not yet reached the bottom position; and when the keycap 10 continues to move downward, the engaging portions 12 approach the two side portions 52 and start pressing the two side portions 52, which in turn exerts a reaction force on the opening portions 121 and the stopper portions 122. Accordingly, the opening portion 121 of each of the engaging portions 12 dilate outwardly such that the two side portions 52 can enter the engaging portion 12 through the opening portion 121.

With reference to FIG. 14, when the keycap 10 is pressed and moves to the bottom position, the opening portion 121*s* of each of the protruding portions 11 on the bottom side of the keycap 10 can be completely engaged with the two side portions 52, and then the two protruding portions 11 of the keycap 10 and the balance bar 50 can be actuated by one another.

The assembly process shown in FIGS. 12 to 14 utilizes the guiding recess 45 to guide and constrain the motion of the two side portions 52 of the balance bar 50, such that when assembling the balance bar 50 with the protruding portions 11 of the keycap 10, the two side portions 52 can be positioned to be in alignment with the opening portions 121 of each of the engaging portions 12, and the two side portions 52 can be fitted into the engaging portion 12 when the keycap 10 is pressed towards the bottom position. Compared with the assembly process of a conventional mechanical key, no auxiliary jigs are needed to fix the two case bodies in the assembly process of the present disclosure.

Through the technical solution provided by the present disclosure, the structure of a key stabilizer as well as the assembly process thereof are simplified, and the need for auxiliary jigs is obviated, which decreases the assembly costs of a key stabilizer.

The description illustrated supra set forth simply the preferred embodiments of the present disclosure; however, the characteristics of the present disclosure are by no means restricted thereto. All changes, alterations, or modifications conveniently considered by those skilled in the art are deemed to be encompassed within the scope of the present disclosure delineated by the following claims.

What is claimed is:

1. A key stabilizer, comprising:

a keycap having a bottom surface and two protruding portions disposed thereon, the keycap moving back and forth along a vertical direction between a top position and a bottom position, each of the two protruding portions having an engaging portion at a bottom end thereof, wherein the bottom surface faces the bottom position, and the two protruding portions are arranged along a horizontal direction that is perpendicular to the vertical direction; and a balance bar having a hinge portion and two side portions respectively connected to both ends of the hinge portion, wherein the hinge portion is positioned on a rotation axis that is parallel to the horizontal direction, an end of each of the two side portions that is away from the hinge portion being inserted into the engaging portion so that when the keycap moves back and forth along the vertical direction, the two protruding portions are actuated by each other through the balance bar, and the two side portions are actuated by the two protruding portions to swing between an uppermost swing position and a lowermost swing position; and a base plate and two case bodies disposed thereon, each of the case bodies including an accommodating concavity into which the bottom end of each of the two protruding portions is inserted, wherein the two case bodies respectively correspond to the two protruding portions, the hinge portion of the balance bar is pivotally connected to one side of each of the two case bodies, and the two side portions of the balance bar is accommodated in the two accommodating concavities respectively and connected to the bottom ends of the two protruding portions respectively.

2. The key stabilizer according to claim 1, wherein each of the engaging portions includes:

an opening portion at one end thereof; and a constraining portion constraining motion of a corresponding side portion inserted into the engaging portion so that the corresponding side portion that has been inserted into the engaging portion cannot exit therefrom.

3. The key stabilizer according to claim 2, wherein each of the case bodies includes a constraining member disposed on the bottom surface of the accommodating concavity, a guiding recess being disposed on each of the constraining members at one side thereof facing the keycap, each guiding recess corresponding to each of the side portions respectively such that when the two side portions are pushed by the bottom ends of the two protruding portions to the lowermost swing position, the guiding recesses fix the side portions at the lowermost swing position in a manner such that the two side portions correspond to the opening portions of the two engaging portions so that when the two protruding portions move to the bottom position along with the keycap, the side portions are fitted into the engaging portions via the opening portions with the guidance of the guiding recesses.

4. The key stabilizer according to claim 3, wherein the two guiding recesses each includes two inclined shoulder portions and one central portion therebetween, a position of each central portion corresponding to each engaging portion, and a height of each central portion corresponding to a height of a lower end of the side portion when the two side portions swing to the lowermost swing position.

5. The key stabilizer according to claim 4, wherein each of the case bodies includes an indented portion at a lateral side thereof, each of the side portions of the balance bar being inserted into an inside of a corresponding case body through the corresponding indented portions, and the hinge portion being accommodated in the corresponding indented portions.

6. The key stabilizer according to claim 5, wherein each of the two indented portions is a notched recess extending upwards from a bottom surface of the case body along the vertical direction, each indented portion having two side walls and one top wall between the upper ends of the two side walls, wherein a distance between the two side walls is greater than or equal to a diameter of the hinge portion such that the hinge portion is accommodated between the two side walls of the indented portion, and wherein at least one of the two side walls includes a fixing protrusion for fixing the hinge portion so that the hinge portion is positioned on the rotation axis.

7. The key stabilizer according to claim 6, further comprising a key shaft disposed on the base plate and connected to the keycap at a bottom side of the keycap.

8. The key stabilizer according to claim 7, wherein the base plate includes a first accommodating hole disposed at a middle position thereof, the key shaft being disposed in the first accommodating hole, and wherein the base plate includes two second accommodating holes on both sides of the first accommodating hole, the two second accommodating holes corresponding to the two case bodies respectively, and the two case bodies being accommodated in the two second accommodating holes respectively.

9. The key stabilizer according to claim 8, wherein each case body includes at least one hook member, and wherein when the case bodies are accommodated in the second accommodating holes, the at least one hook member of each case body is fitted to an edge of each second accommodating hole so that the case bodies are fixed to the second accommodating holes.

10. The key stabilizer according to claim 1, wherein each of the case bodies includes an indented portion at a lateral side thereof, the side portions of the balance bar being inserted into an inside of each case body through the indented portions, and the hinge portion being accommodated in the two indented portions.

11. The key stabilizer according to claim 10, wherein each of the two indented portions is a notched recess extending upwards from a bottom surface of the case body along the vertical direction, each indented portion having two side walls and one top wall between the upper ends of the two side walls, wherein a distance between the two side walls is greater than or equal to a diameter of the hinge portion such that the hinge portion is accommodated between the two side walls of the indented portion, and wherein at least one of the two side walls includes a fixing protrusion for fixing the hinge portion so that the hinge portion is positioned on the rotation axis.

12. The key stabilizer according to claim 11, further comprising a key shaft disposed on the base plate and connected to the keycap at a bottom side of the keycap.

13. The key stabilizer according to claim 12, wherein the base plate includes a first accommodating hole disposed at a middle position thereof, the key shaft being disposed in the first accommodating hole, and wherein the base plate includes two second accommodating holes respectively corresponding to the two case bodies, the two case bodies being accommodated in the two second accommodating holes respectively.

14. The key stabilizer according to claim 13, wherein each case body includes at least one hook member, and wherein when the case bodies are accommodated in the second accommodating holes, the at least one hook member of each case body is fitted to an edge of each second accommodating hole so that the case bodies are fixed to the second accommodating holes.

* * * * *